United States Patent [19]

Hubner et al.

[11] Patent Number: 5,014,363

[45] Date of Patent: May 14, 1991

[54] WEARING APPAREL WITH VENTILATION MATERIAL

[75] Inventors: Thorger Hubner; Walter Bleimhofer, both of Putzbrunn, Fed. Rep. of Germany

[73] Assignee: W. L. Gore & Associates, Inc., Newark, Del.

[21] Appl. No.: 364,941

[22] Filed: Jun. 12, 1989

[30] Foreign Application Priority Data

Jun. 13, 1988 [DE] Fed. Rep. of Germany ..... 3820096
Jun. 13, 1988 [DE] Fed. Rep. of Germany ..... 3820099
Jun. 13, 1988 [DE] Fed. Rep. of Germany ..... 3820100

[51] Int. Cl.[5] ..... A41D 31/00

[52] U.S. Cl. ..... 2/243 A; 2/87; 428/247; 428/255; 428/913

[58] Field of Search ..... 2/87, 243 A; 264/127; 427/202; 428/247, 255, 913

[56] References Cited

U.S. PATENT DOCUMENTS

| | | | |
|---|---|---|---|
| 2,702,764 | 2/1955 | Painter | 428/255 |
| 2,719,804 | 10/1955 | Carlson | 428/255 |
| 2,771,661 | 11/1956 | Foster | 2/87 |
| 3,025,614 | 3/1962 | Bingham, Jr. | 36/3 |
| 3,072,512 | 1/1963 | Dalle | 428/255 |
| 3,623,937 | 11/1971 | Gasaway | 428/255 |
| 3,914,495 | 10/1975 | Lania | 428/255 |
| 3,953,566 | 4/1976 | Gore | 264/127 |
| 4,107,051 | 8/1978 | Lorentzen | 428/255 |
| 4,116,743 | 9/1978 | Davis | 428/255 |
| 4,143,197 | 3/1979 | Jasionowicz | 428/913 |
| 4,154,876 | 5/1979 | Segawa | 427/202 |
| 4,156,753 | 5/1979 | Tanaka | 428/255 |
| 4,194,041 | 3/1980 | Gore | 2/87 |
| 4,308,862 | 1/1982 | Kalmar | 128/91 R |
| 4,316,926 | 2/1982 | Kaminstein | 428/247 |
| 4,348,444 | 9/1982 | Craig | 428/247 |
| 4,454,191 | 6/1984 | von Blucher | 428/913 |
| 4,677,970 | 7/1987 | Green | 128/82.1 |
| 4,775,575 | 10/1988 | Tang | 428/255 |
| 4,778,706 | 10/1988 | Katz | 428/255 |
| 4,816,330 | 3/1989 | Freund | 2/243 A |
| 4,861,651 | 8/1989 | Goldenhersh | 428/255 |

FOREIGN PATENT DOCUMENTS

| | | | |
|---|---|---|---|
| 0127592 | 5/1984 | European Pat. Off. . | |
| 0177892 | 10/1985 | European Pat. Off. . | |
| 2006010 | 8/1971 | Fed. Rep. of Germany | 2/87 |
| 3519905 | 12/1986 | Fed. Rep. of Germany | 2/87 |
| 1252760 | 12/1959 | France . | |
| 2045779 | 2/1987 | Japan | 2/87 |
| 1379633 | 1/1975 | United Kingdom | 2/87 |
| 2169223 | 7/1986 | United Kingdom | 2/243 A |

OTHER PUBLICATIONS

Daniel J. Gohlke and Joseph C. Tanner; *Gore-Tex Waterproof Breathable Laminates;* Mar. 3, 1976.

*Primary Examiner*—Werner H. Schroeder
*Assistant Examiner*—Diana L. Biefeld
*Attorney, Agent, or Firm*—Gary A. Samuels

[57] ABSTRACT

Wearing apparel with an air-impermeable or only slightly air-permeable layer which is lined with ventilation material which has longitudinal air duct and transverse air ducts.

5 Claims, 3 Drawing Sheets

WEARING APPAREL WITH VENTILATION MATERIAL

FIELD OF THE INVENTION

This invention relates to wearing apparel having a layer of flexible ventilation material.

BACKGROUND OF THE INVENTION

Wearing apparel frequently contains air-impermeable or substantially air-impermeable material which result in the formation of sweat at the corresponding part of the body.

One such example is rain jackets or raincoats with a waterproof and air-impermeable outer layer, and an inner fiber lining. Lacking air and water permeability, the outer layer of the clothing cannot release moisture to the outside, instead it is soaked up by the lining. Since the lining is not aired due to the air-impermeability of the outer layer of the clothing, the lining cannot dry, but remains sweat-soaked, which causes a feeling of discomfort and coldness.

Another example is hats, hoods and caps which are lined with an air-impermeable outer layer. In this case also, sweat forms during wearing, which cannot escape but causes the part of the hat, hood or cap which lies against the head to become damp. This also causes discomfort for the wearer, especially a feeling of coldness. Still other examples are gloves and footwear.

SUMMARY OF THE INVENTION

All of these and other similar instances can be remedied by lining the clothing with a ventilation material.

The invention described herein comprises a wearing apparel containing:

(a) a substantially air-impermeable outer material (b) a second material adjacent the outer material, said second material formed by a first layer of a series of parallel, longitudinally disposed spacers; and a second layer of a series of parallel cross spacers transversely disposed with respect to the first layer, said longitudinally disposed spacers being spaced from one another to provide longitudinal air ducts, and said transverse spacers spaced from one another to provide, with the longitudinal spacers, interstices between the transverse and the longitudinal spacers.

Due to the fact that the ventilation material has sufficient air ducts running in the longitudinal direction and air ducts connected with them running in the transverse direction to at least one of its surfaces, air can reach all the areas lined with the ventilation material. In this way, sweat can evaporate and be carried away. The ventilation effect is frequently increased by the fact that the clothing lined with the ventilation material is often moved while in use, which results in a pumping effect in the ventilation material which increases the ventilation behavior.

The wearing apparel is designed in such a way that the longitudinal spacers are adjacent the outer material so that the longitudinal air ducts are directed along the clothing. They are also directed toward an open end or one which does not lie against the body, while the transverse air ducts are directed toward the surface of the body.

DESCRIPTION OF THE INVENTION

Figure 1:
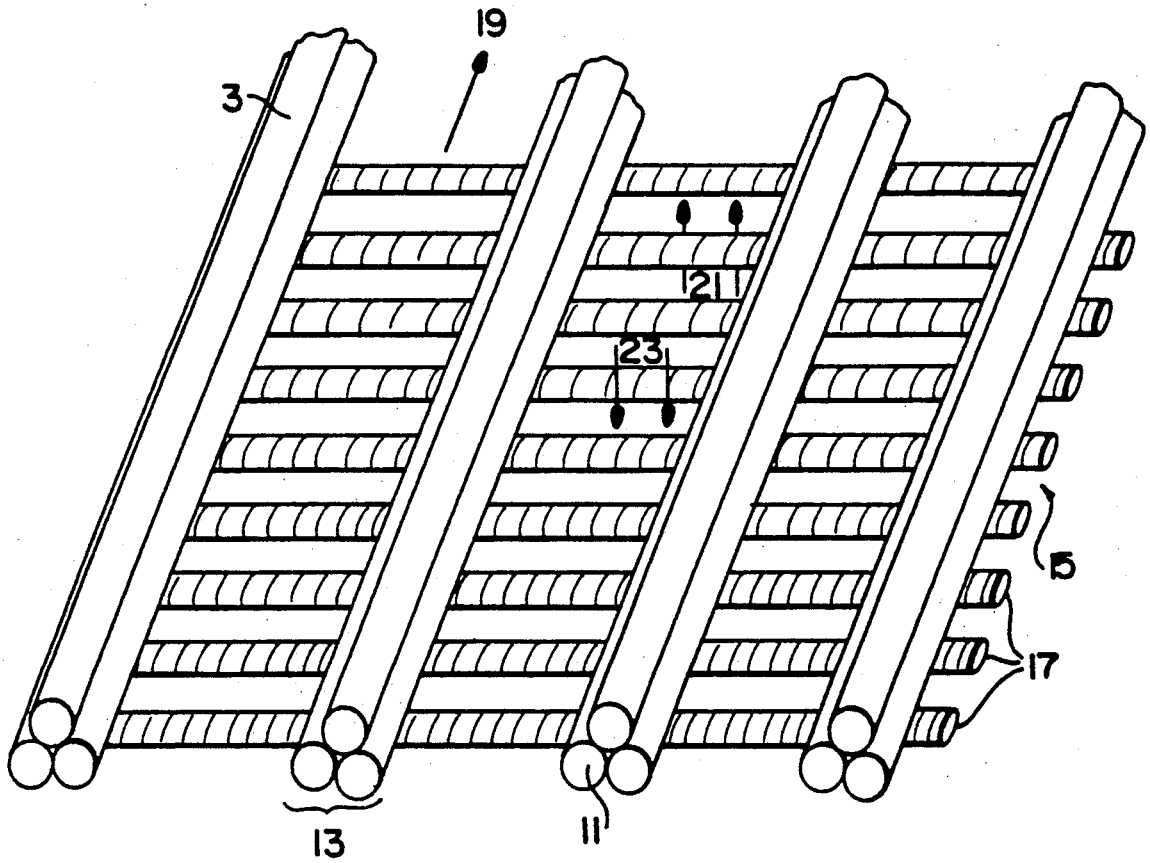
FIG. 1 is a design of a ventilation material used in the invention.

The ventilation material can be structured in a variety of different ways, for example, open-pored, ribbed, burled, with crosspieces, three-dimensional gauze, etc. It is only important to ensure that the longitudinal air ducts and the transverse air ducts connected with them reach at least one surface. In many articles of clothing, even partial lining with the ventilation material can result in a significant improvement in the wearability, for example, in the shoulder area in raincoats, in the knee, waistband and crotch area of waterproof pants, in the headband area of hats, hoods and caps, and in the sole and foot area of hose and shoes, and in the finger area of gloves.

In addition to the ventilation effect, the ventilation material has other advantages. One of these advantages is the cushioning effect, which, in the case of hats, hoods and caps, for example, can be very comfortable. Another advantage is that the ventilation material creates a flexible stiffness to prevent limpness of the apparel.

The ventilation material should be pressure-resistant to a certain extent. This means it should not lose its ventilation function under the pressure which occurs during normal use of the apparel. This means that the air ducts should maintain their shape under this normal pressure to the extent that they can continue to conduct enough ventilation air.

The ventilation material can be made from suitable plastic. Examples include polyamide, polypropylene and polyester in the form of monofilaments or multifilaments, woven or rascheled, or also in the form of reticulated foam material from the same kind of material.

In the case of a foam shoe or a glove lined with the ventilation material, the following order of layer from the outside in is preferred. Examples of this are polyamide, polypropylene and polyester in the form of monofilaments or multifilaments, woven or rascheled, or also in the form of reticulated foam material from the same kind of material.

The outside layer is formed from a waterproof layer. Next comes a damping material whose particular purpose is act as a shock absorber. This is followed by the ventilation material of the invention. Then comes a layer of insulation material. The final layer next to the foot or hand is a layer of knitted fabric, preferably a fiber lining.

The ventilation material is also particularly suitable in combination with a water-impermeable and water vapor-permeable microporous function layer, such as is currently used for waterproof yet air-permeable articles of apparel. This function layer makes it possible for moisture to be released by the function layer. However, if there is only air-impermeable material on the other side of the function layer, this moisture cannot be carried further and accumulates, thus it is not removed from the body. However, if the ventilation material of the invention is placed between the side of the function layer turned away from the body and the air-impermeable outer material, it is possible to supply air to the outside of the function layer and, as a result of the ventilation effect, the body moisture is removed.

FIG. 1 presents a schematic and greatly enlarged example of a design for the ventilation material used according to the invention. Here, three delta-shaped longitudinal crosspieces tied together 13 form a spacer 11 A number of essentially parallel spacers 11 arranged at a distance from one another are connected underneath by means of a number of transverse crosspieces 17 which run crosswise relative to the spacer 11, are arranged at a distance from one another and are essentially parallel. The interstices between each two adjacent spacers 11 form longitudinal air ducts 19. The transverse air ducts 21, 23 connected to them, whereby the transverse air ducts 23 are also formed by the interstices between the spacers 11 and by the longitudinal air ducts 19, conduct inflowing air to the level formed by the interstices between the transverse crosspieces 17 and conduct inflowing air through the longitudinal air ducts 19 to the underside of the ventilation material presented in FIG. 1. Moisture which forms under or on top of the ventilation material can be carried away by means of the transverse air ducts 21 or 23 and the longitudinal air ducts 19.

Figure 2:
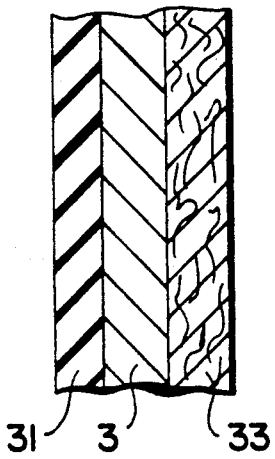
FIG. 2 is a schematic and extracted cross-section through the layer arrangement of a raincoat.

FIG. 2 presents a schematic and extracted cross-section of the layer arrangement of a raincoat. From the outside toward the body, the raincoat has a waterproof, water vapor-impermeable outer material 31, a layer of ventilation material 3 and a fiber lining 33. The ventilation material 3 is oriented in such a way that its longitudinal air ducts lead to an open end or end region of the raincoat or at least to an area of the raincoat which does not lie against the body during normal wear. The transverse air ducts connected with it are directed towards the fiber lining 33 and thus toward the body.

Preferably, the shoulder, chest and back areas of the raincoat are lined with the ventilation material 3. However, it is also possible for the ventilation material 3 to run from the back of the coat to its lower edge This ensures that if the raincoat is worn while sitting, the ventilation function is provided for all body parts which come in contact with the raincoat while in a sitting position.

Figure 3:
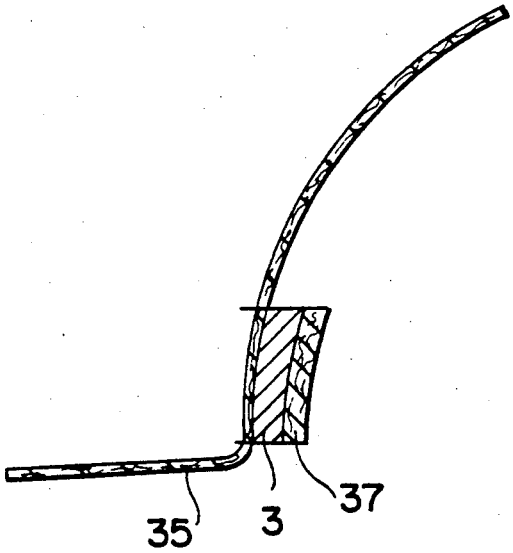
FIG. 3 is a schematic and extracted cross-section of a hat.

FIG. 3 presents a schematic and extracted cross-section of a hat which is lined with the ventilation material. The hat is made from an outer material 35 which usually has a headband 37 attached on the inside. Between the outer material 35 and the headband 37, there is a layer of ventilation material 3 which is oriented in such a way that the longitudinal air duct run parallel to the outer material of the hat and the transverse air ducts connected with it are directed toward the headband 37 and thus toward the head of the wearer.

Figure 4:
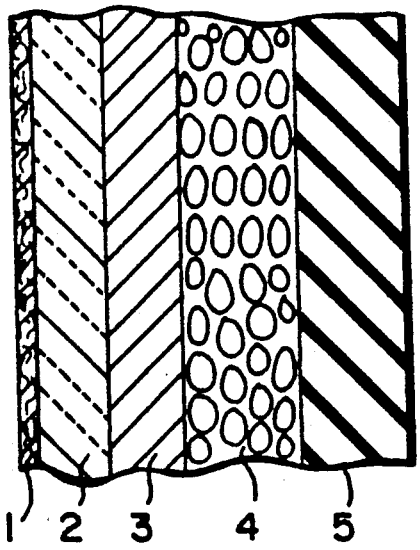
FIG. 4 is a schematic and extracted cross-section of a glove or shoe material.

FIG. 4 presents an example of portion of a glove or footwear lined with ventilation material according to the invention. It presents a schematic and enlarged cross section of glove or footwear with ventilation design. From the skin to the outside, there is first a layer of knitted fabric . which is preferably a fiber lining. Next to the knitted fabric layer 1 is a layer of insulating material 2. This in turn is applied to a layer 3 of ventilation material. Then comes a layer of damping or padding material 4 which is applied to waterproof layer 5, which forms the outer layer of the glove or footwear.

The waterproof layer 5 is air-permeable. The layer of damping material 4, which provides mechanical protection from the hand and acts as a shock absorber, is also air-impermeable or only very slightly air-permeable. The layer of insulating material 2 mainly serves as heat insulation and can be formed from wadding, for example.

Moisture which penetrates the knitted fabric layer and the layer of insulating material 2 could not be carrier away without the layer 3 of ventilation material, but would collect in layers 1 and 2 which would become wet and result in an unpleasant cold feeling. By means of the ventilation effect of layer 3 of ventilation material, air passes over layers 1 and 2, which enables the moisture to be carried away. In this way, moisture can be removed so that the apparel is much more comfortable to wear.

Figure 5:
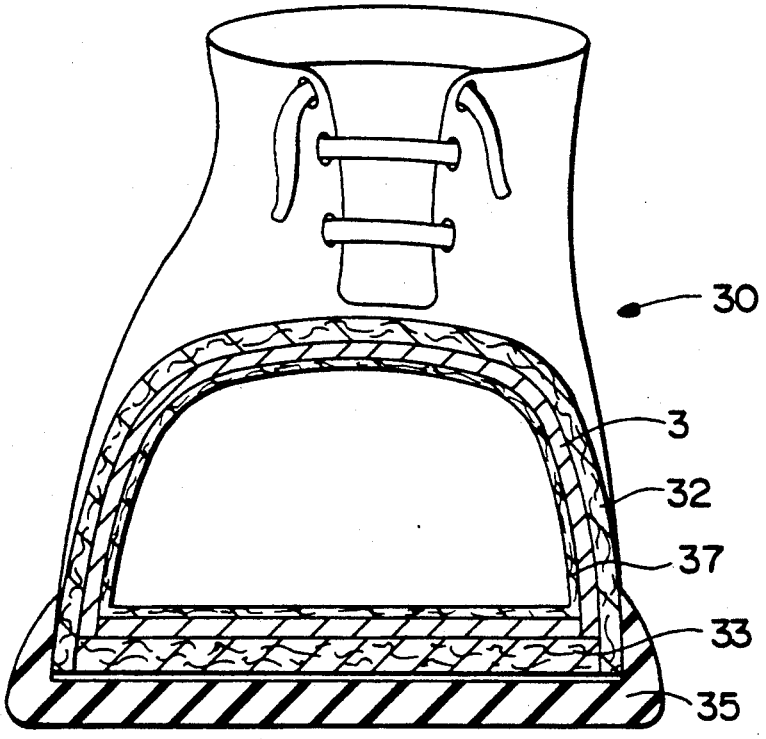
FIG. 5 is a schematic and extracted cross-section of a shoe.

FIG. 5 presents a schematic representation of the frontal view of a shoe from which the toe has been cut away, making a cross-sectional representation possible. The thickness of the individual layers is not presented to scale.

The shoe 30 presented in FIG. 5 has a body 31 which is connected with an insole 33 in a way which is not shown in this diagram. An outsole is extruded onto the underside of the insole, whose sides seal the area where the body 32 joins the insole 33. The inner sides of the body 32 and insole 33 are lined with the ventilation material. The inner layer is a waterproof, water vapor-permeable function layer of the well-known type. The inner layer can also consist of a laminate which has a function layer which is lined on the inside, the laminate can also have a protective layer for the function layer on the side facing the ventilation material 3.

If the shoe body 32 is made of leather it has a certain water vapor permeability which enables the foot moisture formed in the shoe to be released to the outside through the function layer and the leather body. The leather body only has a limited ability to release foot moisture from the inside to the outside, especially if the leather body becomes wet. In this particular case, the ventilation material 3 placed between the inner layer 37 and body 32 achieves a significant improvement. The foot moisture which reaches the outer side of the function layer from the inner area of the shoe can be removed by the ventilation material 3. In so doing, the ventilation material 3 is oriented in such a way that its longitudinal air ducts 19 are directed toward the upper end of the shoe so that air can be brought in and moisture carried away.

The ventilation material 3 is particularly advantageous when the shoe body 32 is made from an air-impermeable material, such as rubber or plastic, rather than leather or another air-permeable material. In this type of shoe, the foot moisture which forms inside the shoe is unable to escape. In this case, the ventilation effect of the laminated ventilation material 3 is particularly noticeable.

In this type of waterproof shoe, the inner layer 37 does not require a function layer, but is usually formed only by lining.

Of course, the invention is applicable and advantageous regardless of whether the shoe is laced or not, as is presented in FIG. 5.

We claim:

1. A wearing apparel comprising:

(a) a substantially air-impermeable outer wearing apparel material (b) a second material adjacent the outer material, said second material comprising a lattice formed by a first layer of a series of parallel, longitudinally disposed plastic spacers; and a second layer of a series of parallel plastic cross spacers transversely disposed with respect to the first layer, said longitudinally disposed spacers being spaced from one another to provide longitudinal air ducts, and said transverse spacers spaced from one another to provide, with the longitudinal spacers, interstices between the transverse and the longitudinal spacers.

2. The wearing apparel of claim 1, wherein the apparel is headwear.

3. The wearing apparel of claim 1, wherein the apparel is a garment.

4. The wearing apparel of claim 1, wherein the apparel is a glove.

5. The wearing apparel of claim 1, wherein the apparel is footwear.

* * * * *